United States Patent [19]

Gray

[11] Patent Number: 4,587,759

[45] Date of Patent: May 13, 1986

[54] LOCKING WINDOW ASSEMBLY

[76] Inventor: Ronald A. Gray, 2600 Camp Creek Pkwy., Apt. 31-D, Atlanta, Ga. 30337

[21] Appl. No.: 615,252

[22] Filed: May 30, 1984

[51] Int. Cl.[4] ..... E06B 3/00

[52] U.S. Cl. ..... 49/50; 49/450; 49/501; 52/106; 292/36

[58] Field of Search ..... 49/449, 450, 501, 395, 49/394, 50; 292/36, 167, 139, 158; 52/106; 109/76, 64

[56] References Cited

U.S. PATENT DOCUMENTS

| | | | |
|---|---|---|---|
| 1,104,076 | 7/1914 | Simmons | 292/32 |
| 1,143,965 | 6/1915 | Higgin | 49/450 X |
| 1,630,153 | 5/1927 | Williams | 49/450 X |
| 2,137,438 | 11/1938 | Bayley | 52/106 X |
| 2,931,599 | 4/1960 | McQuilkin | 49/395 X |
| 3,137,518 | 6/1964 | Dale | 292/36 |
| 3,479,769 | 11/1969 | Diack | 49/449 |
| 3,918,202 | 11/1975 | Smith | 49/50 X |
| 3,990,196 | 11/1976 | Eddins | 52/106 |
| 4,225,163 | 9/1980 | Hubbard et al. | 292/21 |

*Primary Examiner*—Philip C. Kannan

*Attorney, Agent, or Firm*—Jones & Askew

[57] ABSTRACT

An improved reinforced locking window assembly including a rectangular reinforcing structure and a plurality of reinforcing rods. The rectangular reinforcing bar structure aligns with the rails and stiles of a window sash with the rods aligned with the muntins of the sash. A set of troughs and channels are provided in the rails, stiles, and muntins of a pair of sash halves which fit over the reinforcing structure. The two sash halves are joined together around the reinforcing assembly and thus a window sash of conventional appearance, but containing rigid metallic reinforcing elements is provided. The preferred form includes a locking assembly within the check rail of one sash. The lock includes a pair of lock pistons which may be extended longitudinally out of the distal ends of the lock case on the check rail to engage a pair of receiving holes to which they are aligned in the side jambs.

6 Claims, 6 Drawing Figures

LOCKING WINDOW ASSEMBLY

TECHNICAL FIELD

The present invention relates to window structures and in particular locking window arrangements used to provide security for the building incorporating the windows.

BACKGROUND OF THE INVENTION

Recent years have seen disturbing increases in domestic burglaries in the United States and other countries. As more and more homes are burglarized, the public in general has become more conscious of providing physical security for their homes and other buildings. The rapid increase in the number of households in which both husband and wife hold full-time jobs has led to an increase in the opportunities for burglars.

In recent years, electronic security devices have become increasingly popular. However, such security devices tend to be relatively expensive and often require expert installation. Many such arrangements include a contract basis with the company providing the security equipment when such equipment includes apparatus for automatically dialing a home office of the leasing company. Such devices can be either silent alarms, which require a quick response on the part of the local police force, or audible alarms which attempt to frighten the intruder away.

Though such alarms can be very effective, they are, as noted above, somewhat expensive. Furthermore, they tend to be failure prone in the sense that a significance number of false alarms are provided by many such systems. Also, some sophisticated burglars who are after a particular type of goods within the home can break and enter, quickly steal the goods which they seek such as silverware and jewelry, and exit the home prior to the response time of the combination of security equipment provider and local police.

Other physical devices have been provided in the prior art, the main purpose of which is to prevent physical entry into the premises rather than detect same or cause audible alarms upon the occurrence of a break-in. The most popular form of such devices are items traditionally referred to as "burglar bars" or "burglar screens". Such devices are known to be effective for restricting unauthorized entry into a dwelling. However, burglar bars and burglar screens have several drawbacks. First and foremost is the fact that, irrespective of attempts to fabricate burglar bars somewhat inexpensively and make them decorative in appearance, many people consider such devices to be extremely unattractive. Thus, conventional burglar bars and burglar screens are aesthetically displeasing to many people who will often forego use of such devices in favor of maintaining what they believe is a suitable appearance for their home.

A second and related factor to the aesthetic problem with burglar bars and burglar screens is the fact that they give many people the feeling that they are resident in a prison or a fortress of some type. This will also lead many people to forego the use of such devices.

A more significant problem arises when one considers the extent to which people are actually imprisoned by burglar bars and burglar screens in the event of an emergency such as a fire within the dwelling to which they are attached. In order for these devices to be effective, it is necessary for them to be tightly and firmly secured to the outer portions of a window frame or the siding of the home. Needless to say, in the event of an emergency, opening them can be quite difficult. While a number of burglar screens are conventionally attached in a hinged fashion, with padlocks being used to secure the screen at one or more locations, working with a padlock in the event of an emergency is much more cumbersome than working with a fixed window locking device.

Also, there are a number of prior art schemes for locking windows. Many people have used rubber tipped lever arrangements similar in principle to a knock-down door stop. Such a device has a spring-loaded arm secured to the top of the check rail of a bottom sash of a single or double hung window. The rubber foot at the distal end of the arm engages the vertical portions of the upper sash and, by friction, prevents the window from being raised. However, this type of device falls into the class of window locking arrangements which may be defeated once a section of glass from a window is broken.

Thus, in the prior art there has been a conflict between a person's desire to have an aesthetically pleasing window as a part of a home or other building and the extent to which the window may be physically secured to physically prevent the entry of a burglar through it.

SUMMARY OF THE INVENTION

The present invention is one which basically eliminates the above-recited conflict between aesthetics and physical security in connection with securing of window openings. Thus, it is particularly applicable to use for windows in dwelling places, but its use is not so limited. The present invention provides a window which substantially duplicates the physical strength of prior art burglar bars and burglar screens but still has the outward appearance of a conventional window sash with conventional muntins dividing the window panes.

In its preferred form, the present invention includes a rigid reinforcing frame, which is rigidly connected to a rectilinear array of reinforcing rods in positions corresponding to the positions of the muntins on the particular window. This subcombination, in and of itself, provides many of the desirable features of the present invention in connection with any locking device.

In its most preferred form, the structure further includes a lock case rigidly connected to the rectilinear array of the muntin reinforcing rods and the reinforcing bars at the position one normally finds the check rail on the lower sash of a single or double hung window. The preferred form of the lock within the lock case includes a pair of lock pistons which extend outwardly from the distal ends of the lock case at the check rail position. These are attached by articulating arms to a lock stem and cylinder for providing a locking mechanism whereby the lock pistons may be selectively pushed into or withdrawn from a series of holes along the vertical standards in the window frame by which the check rail passes when the window is raised and lowered. Naturally, it is preferred to have one set of such holes in the vertical frame standards located so that they are opposite the lock pistons when the window is closed. However, this structure also allows the user to provide more than one set of such holes in the vertical standards, or side jambs so that partially opened but locked positions may be accomplished with the present invention. Thus, the window may be fully secured in a position in which it is open a distance sufficient to allow ventilation to enter the building, but insufficient to allow even the most diminutive burglar to enter.

Thus, it is an object of the present invention to provide a locking window assembly which provides exceptional physical strength to resist breaking and entering by an intruder, even if such an intruder is willing to use tools to break and clear glass from the panes.

It is a further object of the present invention to provide such a window in which the overall muntin structure will resist the normal force which might be applied by a burglar to break out prior art wooden muntins and thus maintain the overall physical integrity of the reinforced muntin structure.

It is a further object of the present invention to provide an improved locking window structure which possess the physical strength of prior art burglar bars and burglar screens yet has an outward appearance of being a conventional window.

It is a further object of the present invention to provide an improved locking window structure which may be locked at a closed position and a plurality of partially opened positions which does not require a plurality of unsightly holes to be provided in the upper sash of a single or double hung window.

It is a further object of the present invention to provide an improved locking window structure having the physical strength of preexisting burglar bars and burglar screens which may be quickly and readily opened in the event of an emergency requiring the occupants of the building to escape through the opening into which the window structure is placed.

It is still a further object of the present invention to provide a lock structure, particularly suited for use in a rail of a window, with an articulating lock rod structure connecting a lock stem to a lock piston which allows the lock to be contained within a relatively narrow lock case while still providing adequate throw to the lock pistons.

That the present invention meets the foregoing objects, and overcomes the limitations of the prior art cited above, will be apparent from the following detailed description of the preferred embodiment.

DETAILED DESCRIPTION OF THE PREFERRED EMBODIMENT

Figure 1:
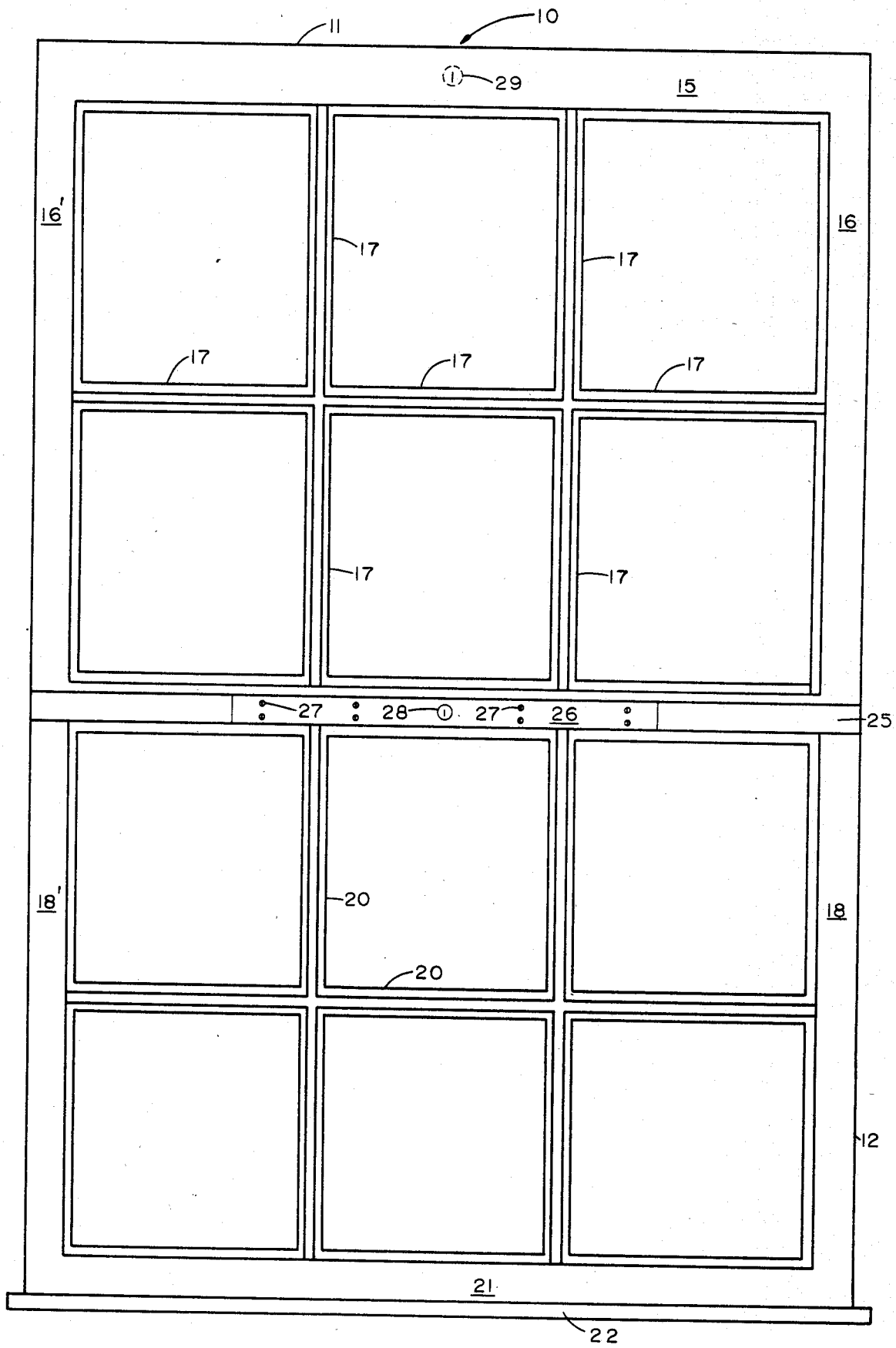
FIG. 1 is a front elevational view of the preferred embodiment of the present invention as viewed from the interior of a building in which the present invention is used.

The preferred embodiment of the present invention will now be described in connection with the drawing figures in which like numerals represent like parts. Turning first to FIG. 1, the preferred embodiment of the present invention is shown generally at 10. The preferred embodiment comprises a single hung window in which the upper sash 11 is secured in a fixed position within the window frame (not shown in FIG. 1) and a lower sash 12 may be raised and lowered.

For the most part, the appearance of window assembly 10 is conventional. Top sash 11 includes a top rail 15, a pair of stiles 16 and 16' and a plurality of muntins or sash bars shown as 17.

Lower sash 12 also includes a pair of stiles designated as 18 and 18' and a plurality of muntins, an exemplary pair of which are referenced as 20. Adajcent to stiles 18 is a bottom rail 21 which tightly engages the window stool 22 when the window is closed, as shown in FIG. 1.

The lower sash 12 includes a check rail 25. Embedded within check rail 25 is a lock case and lock assembly. Visible in FIG. 1 is lock cover plate 26 and a plurality of screws, an exemplary pair of which is shown as 27. An exposed portion of a lock cylinder 28 is also visible in FIG. 1.

From inspection of FIG. 1, it will be appreciated that, except for the apparatus appearing within the boundary of lock cover plate 26, window assembly 10 appears to the casual observer to be a conventional single hung multi-pane window. As will become clear from the following description of the preferred embodiment, it is also possible to include strips of veneer to cover lock cover case 26 so that only the externally visible portion of lock cylinder 28 appears on check rail 25 indicating that the window is anything other than a conventional window. However, this adds additional expense to the fabrication of such windows and it is the inventor's belief that the best mode of practicing the invention does not require such a cover.

Also, as noted above, the preferred embodiment of the present invention is the disclosed single hung window shown herein. However, it will be readily apparent to those skilled in the art from reading of this specification that embodiments of the present invention may be constructed for double hung windows. For example, an additional lock, represented in phantom by a phantom locking cylinder 29, could be positioned in top rail 15 of upper sash 11 where sash 11 was also hung so that it may be selectively opened and closed. Also, upon reading the balance of this disclosure, locking arrangements wherein locks are provided in both check rail 25 of lower sash 12 and the corresponding lower meeting rail, which is understood to be behind check rail 25 as shown in FIG. 1, could be provided.

Figure 2:
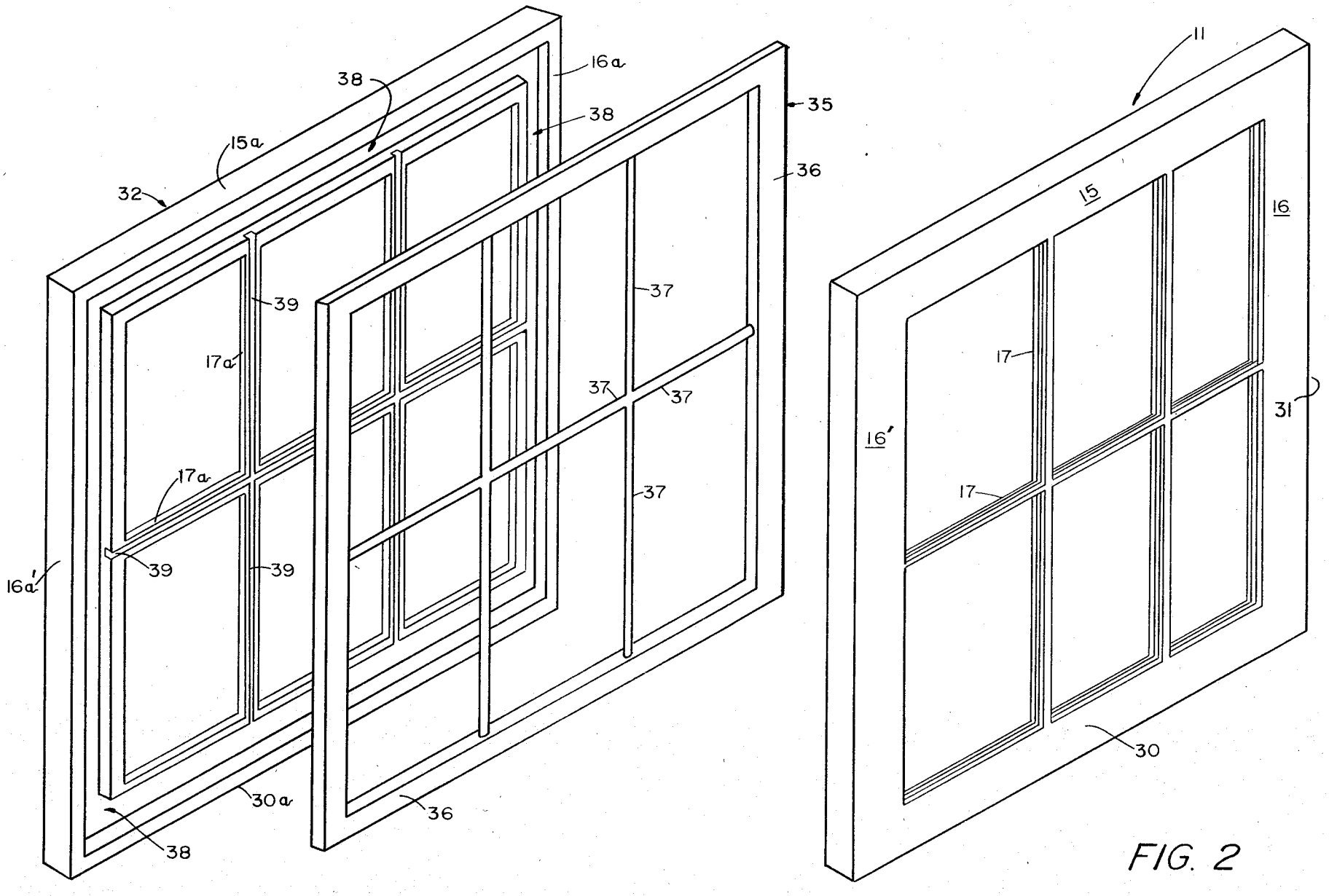
FIG. 2 is an exploded view showing the upper sash structure of the preferred embodiment of FIG. 1.

Turning next to FIG. 2, an exploded view of upper sash 11 is shown. This structure consists of three elements: front sash half 31, rear sash half 32 and a reinforcing structure shown as 35. Front sash half 31 includes the forward portions of top rail 15, stiles 16 and muntins 17. It also includes a lower rail 30. Corresponding parts of rear sash half 32 are numbered with the same reference numerals followed by the modifier "a". Rigid metallic reinforcing assembly 35 includes a rectangular reinforcing bar structure 36 defining the peripheral of reinforcing assembly 35. A plurality of rectilinear muntin reinforcing rods shown as 37 criss-cross the rectangular reinforcing bar structure 36. It should be understood that it is preferred to construct rigid metallic reinforcing assembly 35 from aluminum, steel, cast iron or the like. However, any strong reinforcing material including some modern glass and plastic materials can be used to form assembly 35.

Cut into rails 15*a* and 30*a* and stiles 16*a* and 16*a'* of rear sash half 32 is a receiving trough, shown as 38, which extends around the periphery of the sash half. The rear half muntins 17*a* each have a receiving channel shown as 39 cut into them. It should be understood that rectangular reinforcing bar structure 36 is sized to fit within receiving trough 38 and rectilinear muntin reinforcing rods 37 are sized to fit within receiving channels 39. Thus, when reinforcing assembly 35 is fitted within trough 38 and channels 39, front sash half 31 may be placed over the above-mentioned combination forming a sandwiched structure.

Front and back sash halves 31 and 32 may be joined by any suitable means, but the use of glue is preferred. It should be understood that it is preferred to make front and back sash halves 31 and 32 of wood but any suitable material from which conventional windows are constructed, including aluminum, may be used.

It will be appreciated from the foregoing description that the structure which results from the above-described assembly of elements 31, 32 and 35 provides a window sash which, for all outward appearances, is conventional. However, the use of the rigid metallic reinforcing assembly 35 within the window provides a great deal of added strength while keeping the appearance of the window, to the casual observer, conventional.

It should be noted that there are two alternate approaches to construction of embodiments of the invention as depicted in FIG. 2. The preferred form is that illustrated in which the depth of receiving trough 38 is substantially half the thickness of rectangular reinforcing bar structure 36. Using this arrangement, it will be understood that corresponding receiving troughs and receiving channels are provided in the rails, stiles, and muntins of front sash half 31. However, it is fully within the scope of the present invention to construct embodiments where one and only one of sash halves 31 and 32 include the receiving troughs and channels. Similarly, it is possible, although not preferred, to cut corresponding troughs and channels of different depths in the front and back sash halves so long as the total depth is sufficient to enclose rigid reinforcing assembly 35 when the sash halves are joined.

Figure 3:
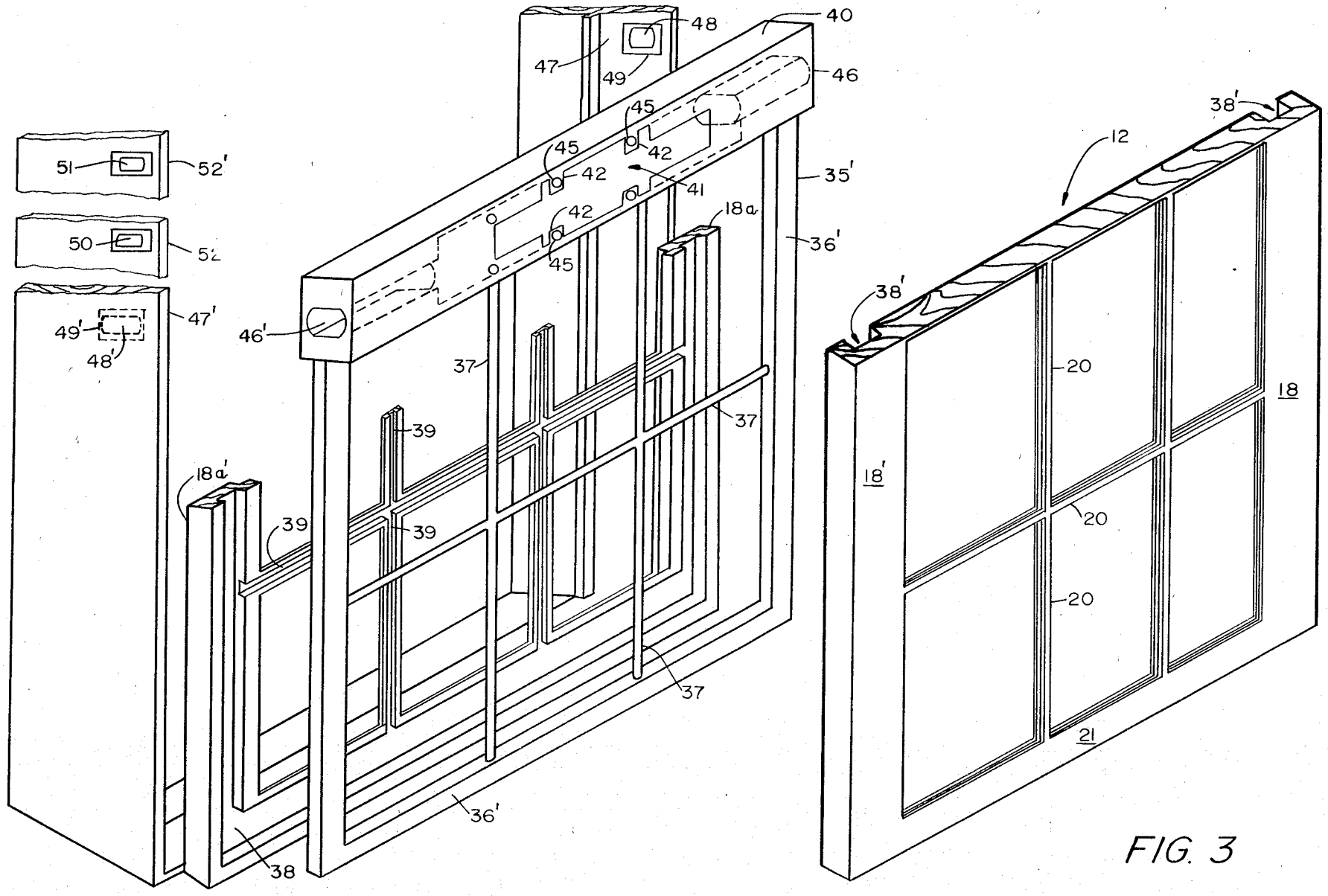
FIG. 3 is an exploded view of the lower sash and side jambs of the preferred embodiment of FIG. 1.

Turning next to FIG. 3, an exploded view of lower sash 12 and the lock case is shown.

Figure 4:
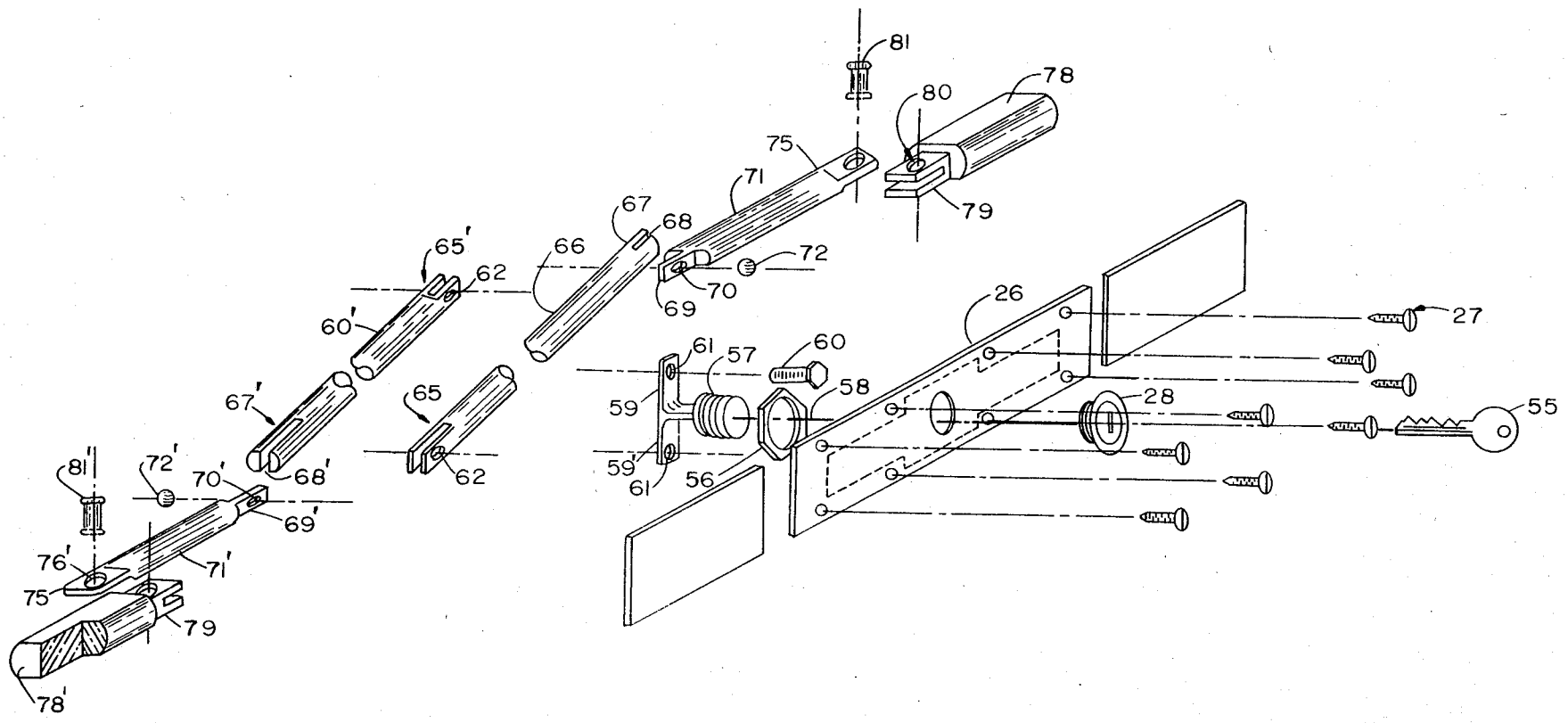
FIG. 4 is an exploded view of the locking structure of the preferred embodiment of the present invention.

As is apparent from inspection of FIG. 3, the construction of sash halves and rigid reinforcing assembly is quite similar to that shown for the upper sash in FIG. 2. The three legs of rigid assembly 35' which reinforce the lower rail and stiles 18 are shown as 36' in FIG. 3. Rigidly connected to muntin reinforcing rods 37 and rectangular reinforcing assembly 36' is a rigid metallic lock case 40. As noted above lock case 40 is located at a check rail position on the lower sash. The lock case includes a rectilinear opening, shown as 41, for receiving the lock assembly described hereinbelow. A plurality of tabs 42 extend partially over opening 41. Tabs 42 carry screw holes 45 which are tapped to receive s crews 27 (FIG. 1, FIG. 4). A pair of longitudinally extending openings 46 and 46' are disposed at the distal ends of lock case 40. As will become apparent from the description of FIG. 4 below, these openings carry lock pistons in the preferred embodiment.

It should be appreciated that lock case 40 forms the upper member of the rigid metallic reinforcing structure for the lower sash of the window assembly of the preferred embodiment. Also shown in FIG. 3 are a pair of side jambs or vertical frame standards 47 and 47'. A pair of receiving holes shown as 48 and 48' are disposed in side jambs 47 so that they are in alignment with openings 46 when the window is in a closed position. As will become apparent from reading the description of the lock mechanism below, a set of locking pistons may be selectively urged into and withdrawn from receiving holes 48 when locking and unlocking, respectively, the window of the preferred embodiment. Surrounding receiving holes 48 are a pair of strike plates 49 and 49'.

Also shown, by way of example on side jamb 47' only, are alternate sets of receiving holes 50 and 51. These are shown as being provided in what is shown as broken sections 52 and 52' of side jamb 47' to indicate that the relatively placement of additional holes 50 and 51 is somewhat arbitrary. The additional receiving holes are provided so that when the window is partially open to a position where opening 46' is in alignment with holes 50 and 51, the window may be locked in a partially opened position. Due to the superior strength of a window sash constructed according to the present invention, it is possible for the user to lock a window in a partially open position which will provide ventilation to the interior of the building in which the window is placed and still prevent unauthorized entry by a criminal.

Also, it will be apparent that the present invention provides a locked window assembly which allows locking in a partially opened position but does not have either the functional or aesthetic drawbacks of prior art arrangements for achieving this end. The drawbacks with spring-loaded lever type stop are described in the background of the invention. The primary problem being that breaking of glass in one of the panes allows a would-be burglar to manipulate, and thus defeat operation of, the lever allowing the window to be raised. On the other hand, it is known in the prior art to provide nails, bolts, wood screws and the like through the check rail of a lower sash into a hole at the meeting rail of the upper sash of the window. Inserting an implement, such as a nail, into these coaxial holes locks the window in a closed position. In order to lock the window in a partially opened position, it is necessary to provide holes in at least one of the stiles of the upper sash. While such an arrangement accomplishes the advantage of having a securely locked window in a partially opened position, it requires that one or more holes be in the stile of the upper sash which holes are visible, and considered unsightly by many people, when the window is closed.

Turning next to FIG. 4, the preferred embodiment of the locking mechanism is shown. Cover plate 26, screws 27 and lock cylinder 28 which have been previously referred to are shown in FIG. 4. Naturally, a key 55 is preferably provided for operating lock cylinder 28. A nut 56 connects lock stem 57 to key cylinder 28. Lock stem 57 is rotated about its longitudinal axis, shown on line 58, in response to operation to the key cylinder in a conventional manner. A pair of radially disposed arms 59 extend from the rearward end of lock stem 57. A bolt passes through opening 61 in the upper one of radial arms 69. It should be understood that a corresponding bolt (not shown) is passed through the bottom hole 61' and will proceed through openings 62 in slotted end 65 of lock rod 66. From inspection of the remaining elements on FIG. 4, it will be appreciated that there is lateral symmetry between the left-hand and right-hand side of the elements shown. Thus, for each element given a particular reference number, a corresponding element bearing the same reference number with the prime symbol will be provided on the left-hand side. It should be understood that arm 59 on lock stem 57 engages the slot at slotted end 65 of lock rod 66 so that holes 61 and 62 are in alignment with the shaft of bolt 60. The other end 67 of lock rod 66 also contains a slot 68. This slot fits over a stem 69 having a hole 70 therethrough, the stem extending from a second lock rod 71.

In the preferred embodiment, a ball bearing 72 is placed within hole 70 before slot 68 is dropped over stem 69. It should be appreciated that under slot 68 is an opening (not shown) of sufficient size to pass the portions of ball bearing 72 which extend past the sides of stem 69 so that lock rods 66 and 71 are secured to each other but free to rotate about an axis transverse to the longitudinal axis of lock rod 71.

A second stem 75 extends from the far end of lock rod 71. Stem 75 includes planar surfaces which are rotated 90° with respect to stem 69. A hole 76 is provide in stem 75. Locking piston 78 forms the distal end of the lock assembly. The near end of lock piston 78 includes a slotted member 79 having a pair of coaxial holes 80 therethrough. Stem 75 is inserted into the slot on slotted members 79 and a rivet 81 is passed therethrough thus joining stem 75 to lock piston 78. Thus, lock rod 71 and lock piston 78 are securely joined together but are free to rotate with respect to each other about a vertical axis. As is shown on the left-hand lock piston 78', it is preferred to have the lock pistons constructed of solid metal.

From the foregoing description of the locking mechanism, it will be apparent that lock rods 66 and 71 comprise articulating rod means connecting lock piston 78 to lock stem 57 for selectively causing lock piston 78 to extend from and withdraw into the distal end of lock case 40 (FIG. 3).

It will also be appreciated that the above-described connections between lock stem 57 and lock piston 78 provide a vehicle for translating the rotational motion of lock stem 57 into longitudinal motion of lock piston 78. The difference in elevation encountered by slotted end 65 of rod 66 as arms 59 and 59' are rotated from a horizontal to a vertical orientation is offset by rotation about a horizontal axis passing through ball bearing 72 between lock rods 66 and 71.

Figure 5A:
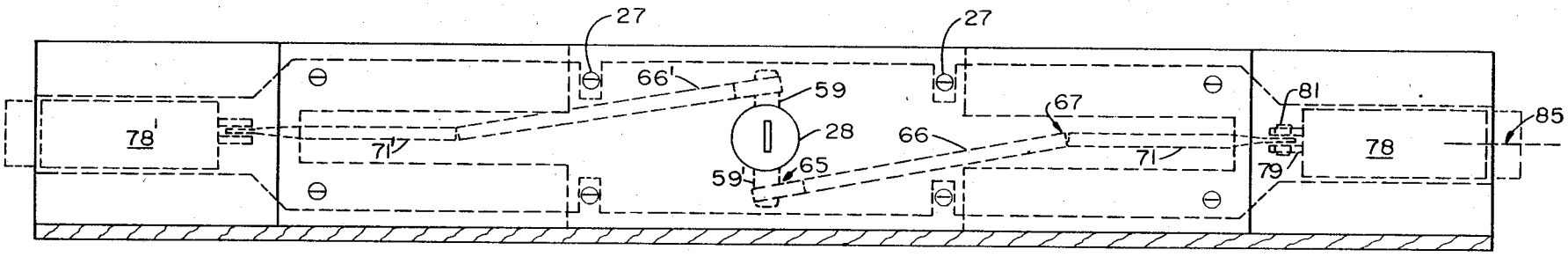
FIG. 5A is an elevational view of the preferred embodiment of the lock of the present invention as assembled.
Figure 5B:
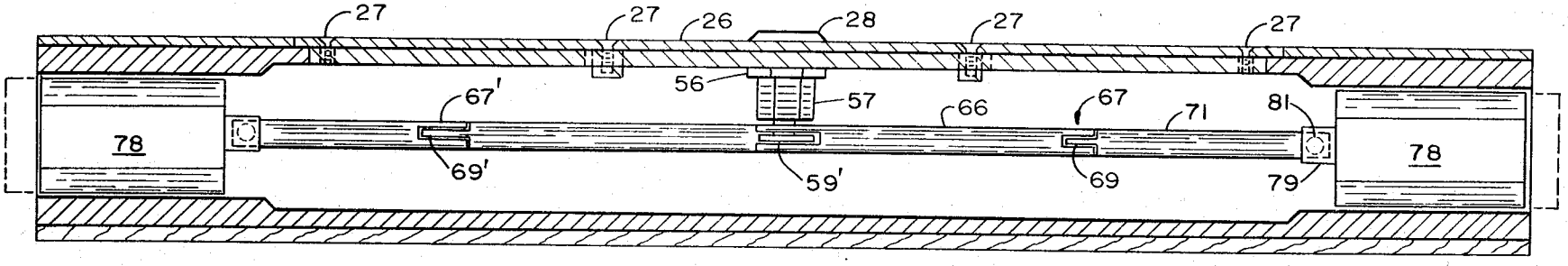
FIG. 5B is a bottom view of the preferred embodiment of the lock of the present invention as assembled.

Turning next to FIGS. 5A and 5B, the preferred embodiment of the lock of the present invention is shown in an assembled form. Like parts from FIG. 4 are referenced with like reference numerals on FIGS. 5A and 5B. From the foregoing description of FIG. 4, and observation of FIGS. 5A and 5B, it can be seen that the use of a pivotal connection at end 67 of first lock rod 66 allows arms 66 and 71 to articulate as piston 78 is advanced and withdrawn along longitudinal axis 85. The use of a pivotal connection at end 67 allows the structure to be placed in a relatively narrow lock case and still accomplish a relatively large throw.

It should be understood that at ends 65 and 67, and at bolt 81, the lock rods 66 and 71, and lock piston 78 are pivotally connected. At ends 65, and through end 79 of lock piston 78, the pivotal connections are accomplished by shafts defining axes of rotation. As noted in connection with FIG. 4, a ball bearing joint is used at end 67 of lock rod 66. However, it should be understood that as used herein, the term pivotal connection can include any form of pivotal connection allowing at least one degree of freedom, including ball and socket joint arrangements, where appropriate.

In the preferred form of the present invention, the pivotal connection at end 65 (see FIG. 4) causes arm 59' and first lock rod 66 to rotate about an axis of rotation parallel to the axis of rotation of lock stem 57. Similarly, the pivotal connection at point 67 allows lock rods 66 and 71 to also rotate about an axis of rotation parallel to the axis of rotation of lock stem 28. In the preferred embodiment, rivet 81 defines an axis of rotation between lock rod 71 and lock piston 78, which axis of rotation is perpendicular to both longitudinal axis 85 and the axis of rotation of lock stem 57.

It should be noted that the preferred embodiment, as shown in FIG. 5A, provides a greater throw of piston 78 along longitudinal axis 85 than a structure having a sing le straight rod substituted for lock rods 66 and 71, connected between end 65 and end 79. Since, in the preferred embodiment, lock rod 71 is merely a longitudinal extension from rivet 81, it can be readily appreciated from elementary trigonometry that the length of lock rod 66 between its two axes of rotation at ends 65 and 67 may be considered a length L1. The length of arm 59' between the axis of rotation of lock stem 57 and the axis of rotation defined by the point at which it is connected to end 65, may be considered length L2. Since the length L2 may be considered to limit the width of the case in which the lock is held, next a situation which length L2 is held constant and a longer length for lock rod 66 should be considered. The limiting case is, of course, one in which length L1 for lock rod 66 extends completely between point 65 and end 79 at which the lock rod is joined to the piston. This arragement is conventionally used in cabinet door locking devices in the prior art.

From the application of basic trigonometry, it may be readily appreciated that the throw of piston 78 (which may be expressed as T) which is accomplished by rotating lock stem 57 90°, from the position shown in FIG. 5A to a position which arms 59 are aligned on longitudinal axis 85, may be expressed by the following formula:

$$T = L2 + L1\ (1\text{-}\cos(\arcsin\ (L2/L1))) \qquad (1)$$

From a fundamental identity for the arcsin function (page 192, CRC Standard Math *Tables,* 19th Edition), it will be appreciated that the above formula reduces to:

$$T = L2 + L1 - \sqrt{L1^2 - L2^2} \qquad (2)$$

From equation (2) above, it will be readily apparent that as L1 increases (bringing an arrangement closer to the prior art), the limiting case for throw T is simply distance L2. This is the conventional arrangement in the prior art which, in order to increase the throw of a lock piston, required the length of radially extending arms (corresponding to arms 59) to be increased proportionately. However, in using the arrangement of the present invention, it will be appreciated that by shortening lock rod 66, and providing an additional lock rod 71 lying along longitudinal axis 85, the throw of the arrangement may be increased without increasing the length of arms 59. From examination of equation (2) above, it is clear that the limiting example is one in which L1 is equal to L2 causing the throw to be equal to $2 \times L2$. Of course, this limiting case is impractical since with arms 59 in the position shown on FIG. 5A, the element corresponding to lock rod 66 (having length L1) would lie parallel to arms 59. However, the shortening of the element corresponding to lock rod 66 brings the throw of piston 78 to a value which is closer to 2×L2 than arrangements in the prior art.

Thus, the use of the articulating lock rod arrangement of the present invention allows the shortening of lock rod 66 so that the throw of piston 78 along longitudinal axis 85 may be increased while holding the length of radially extending arms 59 constant.

From the foregoing description it will be apparent that the preferred embodiment of the present invention accomplishes the objects set forth above and overcomes a number of the previously noted drawbacks in the prior art. It will be understood that the foregoing has been a description of the preferred embodiment and that other embodiments may be constructed within the scope of the present invention. For example, while it is preferred to have the above-noted lateral symmetry between the left-hand and right-hand ends of a locking mechanism shown in FIG. 4, embodiments of the present invention may be constructed in which the equivalent of locking piston 78 is provided only at one end of lock case 40. Also, while it is preferred to have the reinforcing structures 35 and 35' and lock case 40, constructed of metal, such a construction is not essential to the present invention so long as the materials are of sufficient strength relative to conventional window materials.

Based on the foregoing description of the preferred embodiment, other embodiments of the present invention will suggest themselves to those skilled in the art and thus the scope of the present invention is to be limited only by the claims below.

I claim:

1. An improved locking window assembly comprising in combination:

a pair of rectangular peripheral rail and stile assemblies, each having a receiving trough therein;

a plurality of rectilinear muntins, each having a receiving channel therein, disposed within each of said pair of rectangular peripheral rail assemblies;

a rigid metallic reinforcing assembly including a rectangular reinforcing bar structure sized to fit within said receiving trough and a plurality of rectilinear muntin reinforcing rods connected to said reinforcing bar structure to fit within said receiving channels; and means for securing said pair of rectangular peripheral rail and stile assemblies and said plurality of rectilinear muntins together, with said rigid metallic reinforcing assembly secured thereinbetween.

2. An improved locking window assembly as recited in claim 1 wherein said window assembly includes a check rail, and further including:

a locking mechanism including a rigid metallic lock case disposed within said check rail and rigidly secured to said rectangular reinforcing bar structure;

a pair of lock pistons disposed longitudinally within said check rail;

lock stem and lock cylinder apparatus extending transversely to said check rail, said lock stem being connected to said lock pistons;

whereby said lock pistons are selectively extended from and withdrawn into the distal ends of said check rail.

3. An improved locking window assembly as recited in claim 2 wherein said window assembly further comprises a pair of window frame standards defining a path along which said distal ends of said check rail travels when said window is opened and closed, and further comprising:

means defining a plurality of receiving holes in said window frame standards for receiving said lock pistons to provide at least one locked position for said window assembly.

4. An improved locking window assembly as recited in claim 1 wherein said window assembly includes a check rail and a pair of vertical frame standards, and further comprising:

a rigid metallic lock case disposed within said check rail and rigidly secured to said rectangular reinforcing bar structure;

at least one lock piston disposed longitudinally within said check rail;

lock stem and lock cylinder apparatus extending transversely to said check rail, said lock stem being connected to said lock piston to cause said lock piston to be selectively extended from and withdrawn into a distal end of said check rail;

means defining at least one receiving hole in at least one of said pair of vertical frame standards for selectively receiving said lock piston to define at least one locked position for said window assembly.

5. An improved locking window assembly as recited in claim 4 wherein said means for defining at least one receiving hole in said vertical frame standard comprises means for defining a plurality of said receiving holes in said vertical frame standard with one of said receiving holes defining a closed said locked position for said window assembly and another of said receiving holes defining a partially opened lock position for said window assembly.

6. An improved locking window assembly comprising in combination:

a rigid metallic lock case disposed horizontally at a check rail position;

at least one lock piston slidably positioned longitudinally within said lock case;

a lock stem and operating cylinder assembly extending transversely through said lock case;

articulating rod means connecting said lock piston and said lock stem for selectively causing said lock piston to extend from and withdraw into a distal end of said lock case in response to selective operation of said lock stem and cylinder assembly;

a rectilinear array of reinforcing bars and reinforcing muntin rods rigidly connected to said lock case; and a correspondingly rectilinear non-metallic rail and muntin assembly attached to said rectilinear array and covering same from view.

* * * * *